US009655392B2

(12) United States Patent
Mekler et al.

(10) Patent No.: US 9,655,392 B2
(45) Date of Patent: May 23, 2017

(54) FILTERING FACE MASK

(71) Applicants: Jeffrey Mekler, Cambridge, MA (US); Stephanie Morgan Scott, San Francisco, CA (US); Denise Thornberry, Lima (PE); Christopher J. Wilson, Concord, MA (US)

(72) Inventors: Jeffrey Mekler, Cambridge, MA (US); Stephanie Morgan Scott, San Francisco, CA (US); Denise Thornberry, Lima (PE); Christopher J. Wilson, Concord, MA (US)

( * ) Notice: Subject to any disclaimer, the term of this patent is extended or adjusted under 35 U.S.C. 154(b) by 452 days.

(21) Appl. No.: 14/274,753

(22) Filed: May 11, 2014

(65) Prior Publication Data

US 2014/0332012 A1 Nov. 13, 2014

Related U.S. Application Data

(60) Provisional application No. 61/822,286, filed on May 10, 2013.

(51) Int. Cl.

| | |
|---|---|
| ***A41D 13/11*** | (2006.01) |
| ***A62B 23/02*** | (2006.01) |
| ***A62B 18/08*** | (2006.01) |

(52) U.S. Cl.

CPC ..... *A41D 13/1123* (2013.01); *A41D 13/1161* (2013.01); *A62B 18/084* (2013.01); *A62B 23/025* (2013.01); *A41D 13/1138* (2013.01)

(58) Field of Classification Search

CPC . A41D 13/11; A41D 13/1107; A41D 13/1115; A41D 13/1123; A41D 13/1138; A41D 13/1161; A62B 23/00; A62B 23/02; A62B 23/025

USPC ..... 128/863

See application file for complete search history.

(56) References Cited

U.S. PATENT DOCUMENTS

| | | | | |
|---|---|---|---|---|
| 1,523,884 | A * | 1/1925 | Leduc | A41D 13/1115 128/863 |
| 4,673,084 | A | 6/1987 | Hubbard | |
| 6,123,077 | A | 9/2000 | Bostock | |
| 6,394,090 | B1 | 5/2002 | Chen | |
| 2008/0079255 | A1 | 4/2008 | Nakamura | |
| 2012/0017911 | A1 | 1/2012 | Choi | |
| 2012/0060258 | A1 * | 3/2012 | Stewart | A41D 13/1107 2/206 |

(Continued)

FOREIGN PATENT DOCUMENTS

| | | |
|---|---|---|
| EP | 0820386 | 5/1999 |
| EP | 2486960 | 8/2012 |

OTHER PUBLICATIONS

"Child's Face Mask", Kimberly-Clark, <URL: http://products.kchealthcare.com/childs-face-mask-disney-ages-4-12.html>; retrieved on May 10, 2014.

(Continued)

*Primary Examiner* — Kari Rodriquez

(74) *Attorney, Agent, or Firm* — Andover Patents, LLC; Daniel N. Beinart

(57) ABSTRACT

A filtering face mask includes a top layer, a structure layer, one or more filtering layers, a back layer and straps. The straps, the ends of which are attached to the mask, run through strap holes in the mask, and may be pulled to change the mask from a flat to a wearable configuration. The unpleated top layer may easily be decorated before wearing the mask.

14 Claims, 16 Drawing Sheets

(56) References Cited

U.S. PATENT DOCUMENTS

| | | | | |
|---|---|---|---|---|
| 2012/0318273 | A1* | 12/2012 | Tsuei | A62B 23/025<br>128/206.19 |
| 2012/0325843 | A1 | 12/2012 | Tsuei | |

OTHER PUBLICATIONS

"3M Health Care Particulate Respirator and Surgical Masks", 3M Health Care, Aug. 29, 2013.
"Breathe Cool, Stay Safe", Drager, Sep. 8, 2009.
"1712 N95 Flat Fold Respirator & Surgical Mask", Moldex, Sep. 27, 2010.

* cited by examiner

FILTERING FACE MASK

CROSS-REFERENCE TO RELATED APPLICATIONS

This application claims priority to U.S. Provisional Application No. 61/822,286 filed May 10, 2013, the entire contents of which are hereby incorporated by reference, as if fully set forth herein.

TECHNICAL FIELD

The present invention relates generally to the field of filtering face masks and for packaging arrangements for such masks.

BACKGROUND

A filtering face mask, which is capable of filtering air to reduce the presence of certain substances, e.g., microbes and dust, may find usefulness for a variety of purposes. For example, a surgical mask or surgical N95 respirator may be used in a medical setting (e.g., a hospital or a doctor's office), for the purpose of protecting a patient from disease or other airborne contamination, or preventing the spread of disease from the face mask wearer (e.g., a patient, a clinician or a visitor) to patients. As another example of a filtering face mask, an industrial N95 respirator may be used in an industrial setting (e.g., a furniture factory) to provide respiratory protection to a person working in that setting.

It has been shown that it is beneficial for a medical patient, particularly a pediatric patient, to decorate a filtering face mask before the mask is worn. Whether a filtering face mask is worn by the patient or by a clinician working in the presence of the patient, being able to decorate a filtering face mask provides advantages that include enhancing the emotional comfort of the patient. When a mask to be worn by the patient is decorated, the mask becomes more visually appealing. Decoration also reduces the social stigma associated with wearing a mask, thereby enhancing the emotional comfort of the patient. Similarly, when a mask to be worn by a person other than the patient (e.g., a clinician or a visitor) is decorated, the distraction experienced by the patient while decorating the mask and the visual appearance of the decorated mask worn by the other person helps to reduce anxiety and discomfort experienced by the patient. Some existing filtering face masks are packaged in a three-dimensional configuration, which is suitable for wearing, but makes it difficult to decorate the mask. Other existing filtering face masks are packaged in a substantially flat configuration, but they are pleated (i.e., having folds where the material is doubled upon itself) to allow changing to a three-dimensional wearable configuration, and thus decorations created by a patient while the mask is flat are not preserved when the pleats separate when the mask is made wearable. Furthermore, certain sections of a pleated mask that are visible in its three-dimensional configuration are hidden when the mask is in its original flat configuration, thus, it is not possible for a person to decorate these hidden sections when the mask is flat. Therefore, it is not possible for a person to create a decoration of a mask when the mask is flat that is maintained in its original form when the mask is made wearable.

Furthermore, existing filtering face masks that are packaged in a substantially flat configuration are not easily changed to a three-dimensional configuration suitable for wearing, frequently requiring multiple actions by a person in order to accomplish such a change.

Another drawback of existing filtering face masks is that they can easily be changed back from their wearable three-dimensional configuration to a flat, two-dimensional configuration. This is a problem when the wearer of such a mask is a child (e.g., a pediatric medical patient), since ensuring maximum compliance (i.e., the child does not stop wearing the mask when it should be worn) is a medical goal. Thus, it is not desired that such a wearer be able to easily change the mask back to a non-wearable configuration, as this will tend to reduce the child's compliance.

Lastly, existing filtering face masks intended for use by pediatric medical patients do not possess rigidity that is sufficient to prevent their collapse and contact with a wearer's face when the wearer inhales. This behavior causes physical discomfort to the wearer, and can interfere with the ability of the wearer to breathe freely while wearing such a filtering face mask.

Therefore, a need exists for a filtering face mask that is packaged, and may be shipped and stored, in a substantially flat, two-dimensional configuration that is suitable for decorating, but preserves decoration when changed to a three-dimensional configuration suitable for wearing. Furthermore, a need exists for a filtering face mask that allows a person to easily change the filtering face mask to a three-dimensional configuration suitable for wearing. A need also exists for a filtering face mask that is not easily changed back from its wearable, three-dimensional configuration to a flat, two-dimensional configuration, and for a filtering face mask that does collapse and contact a wearer's face when the wearer inhales.

A device constructed according to the principles of the present invention addresses these deficiencies.

SUMMARY

A filtering face mask is provided that can include two straps, each having a first and second end point, and one or more layers comprising two or more strap holes. The layers may be substantially flat. A filtering face mask may include a nosepiece made of flexible, semi-rigid material. The end points of each of the straps are attached to the layers at a first and a second attachment point and the straps run through the strap holes. An action of pulling the straps may be performed to cause the mask to undergo a configuration change from a substantially flat configuration to a substantially three-dimensional configuration.

In some implementations, the following features can be present in any suitable combination. In some implementations a filtering face mask can also include one or more structure layers comprising material sufficient to maintain said substantially three-dimensional configuration. The structure layers can include two or more cutout areas, where no structure layer material exists; the cutout areas facilitate the ability of the mask to fold during the configuration change due to the absence of structure layer material in the cutout areas. The cutout areas may be substantially triangular in shape. The structure layers may be comprised of a mesh material.

The layers may include one or more filter layers comprised of material sufficient to reduce the presence of certain substances in air that passes through the layers. At least one structure layer may be disposed between two of the filter layers. The layers may be comprised of a non-woven polypropylene material.

In some implementations, each of the cutout areas has a first vertex and a second vertex adjacent to the perimeter of the layers, where the first and second attachment points are each disposed outside of one of the cutout areas and adjacent to the perimeter of the layers and more proximal to the first vertex of the cutout area than the second vertex, and two of the strap holes are disposed adjacent to, and on opposing sides of, the second vertex of the cutout area.

In some implementations, the layers of the face filtering mask fold when the straps are pulled causing the mask to undergo the configuration change. The pulling action may be a single action of pulling the straps in substantially opposing directions performed by a person.

One of the layers may be a top layer comprised of material suitable for graphic decoration that remains substantially unbroken and continuous after the configuration change. The top layer may be unpleated and may have preprinted decorative images.

Other objects and features of the present invention will become apparent from the detailed description considered in connection with the accompanied drawings. It is to be understood however, that the drawings are designed as an illustration only and not as definition of the limits of the invention. It is obvious that many changes and modifications may be made thereunto without departing from the spirit and scope of the invention.

DETAILED DESCRIPTION

Figure 2:
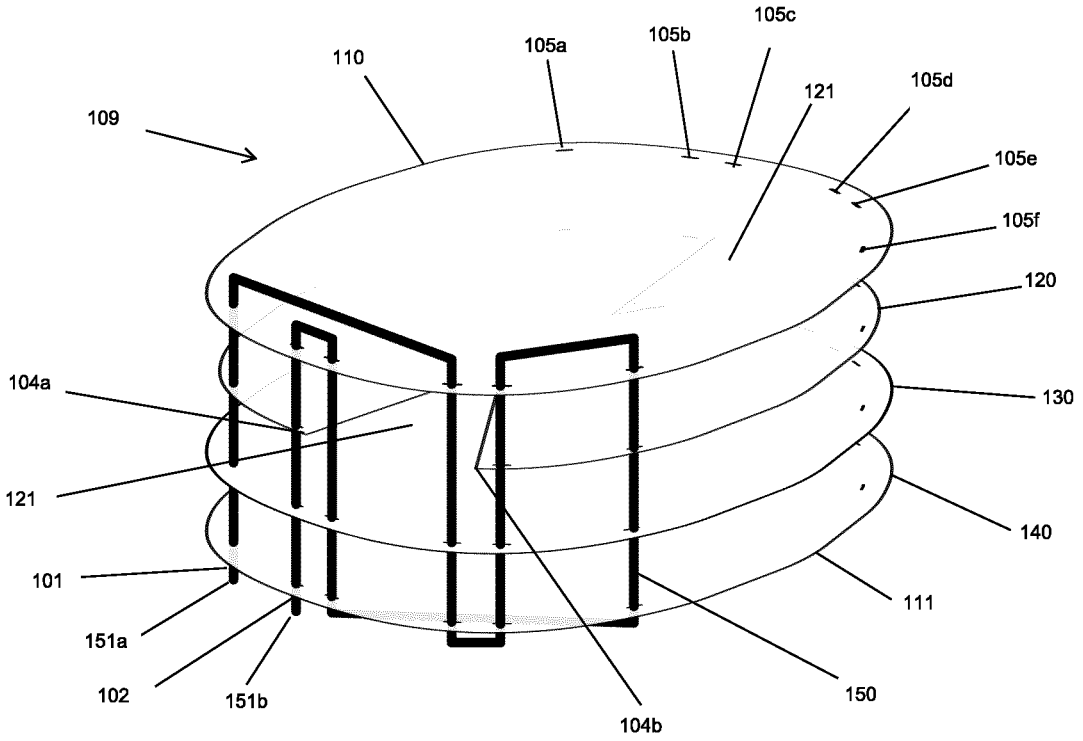
FIG. 2 depicts a first exploded view of some components of a filtering face mask in accordance with principles of the present invention.
Figure 3:
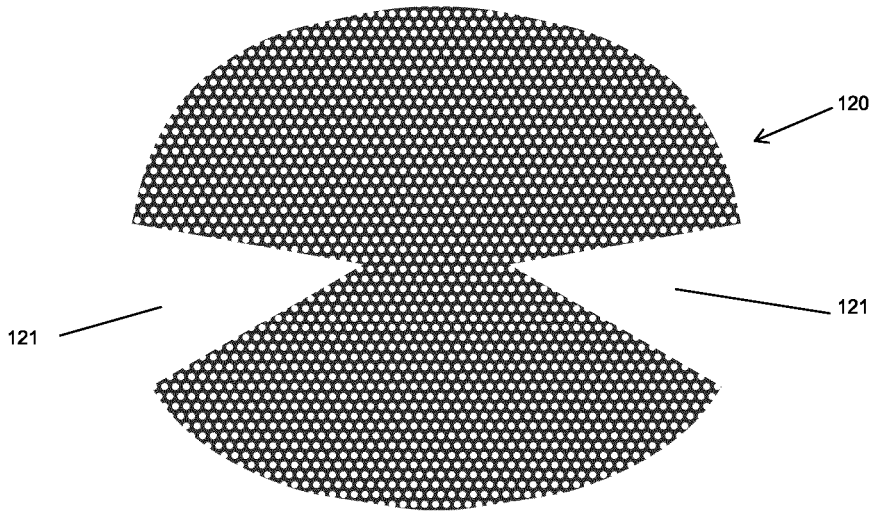
FIGS. 3 and 4 depict a structure layer of a filtering face mask in accordance with principles of the present invention.

An embodiment of a filtering face mask 100, as depicted in FIGS. 2 and 3, comprises a set of layers 109 comprising a top layer 110, a structure layer 120, a filter layer 130, a back layer 140, and two straps 150. As depicted in FIG. 2, the structure layer 120 is disposed between the top layer 110 and the filter layer 130, however, in an alternate embodiment, the filter layer 130 is disposed between the top layer 110 and the structure layer 120. In all embodiments, the structure layer 120 and the filter layer 130 are both disposed between the top layer 110 and the back layer 140. A filtering face mask is typically worn by a person with the back layer 140 against the person's face and the top layer 110 facing outward, and with the straps 150 extended over and behind the person's head, or over and behind the person's ears.

Another embodiment of a filtering face mask 100 further comprises a second filter layer (not shown), where the structure layer 120 is disposed between the first filter layer 130 and the second filter layer. In such an embodiment, the placement of the structure layer 120 as described is advantageous, providing separation between each filter layer, thereby enhancing the effectiveness of the dual-filter configuration. Without such separation, a dual-filter configuration would be less effective.

One skilled in the art will recognize that alternate embodiments of a face filtering mask may comprise more than a single structure layer.

In some embodiments of a filtering face mask 100, some or all of the layers are comprised of a non-woven polypropylene material or of any other sufficiently breathable and strong material. The filter layer 130 (and second filter layer, if any) may be comprised of a material, such as a non-woven material, that reduces the presence of certain substances and particles (e.g., microbes and dust) in the air that passes through the mask. An example of such a material is DelPore DP2001-10P manufactured by DelStar Technologies (http://www.delstarinc.com/delpore.html).

The structure layer 120 may be comprised of a rigid material sufficient to maintain a three-dimensional configuration of a filtering face mask 100 that allows a filtering face mask 100 to be used on a person's face. In some embodiments, structure layer 120 is comprised of a mesh material, e.g., Polypropylene Mesh XN 6070 sold by Industrial Netting (http://www.industrialnetting.com/plastic_poly.htm#search). Additional description of the three-dimensional configuration is provided below.

Top layer 110 and back layer 140 may be comprised of a non-woven polypropylene such as Spunbound PP 10g by Hanes Engineered Materials or similar material.

Figure 4:
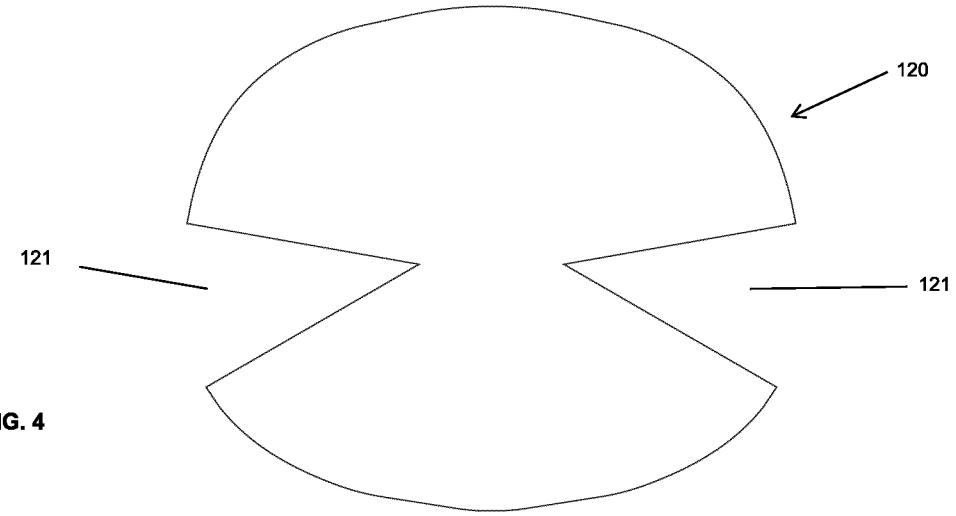
Figure 5:
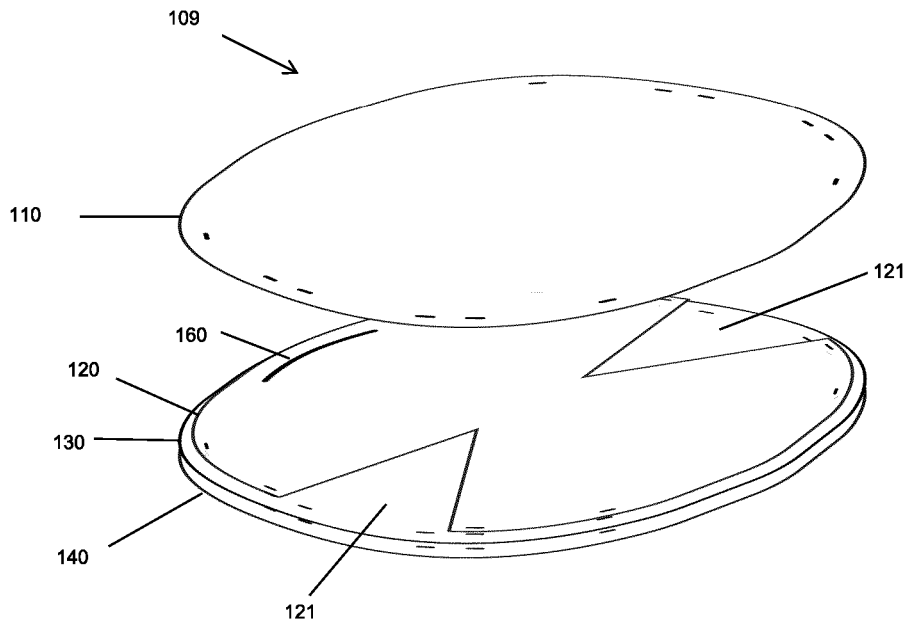
FIG. 5 depicts a second exploded view of some components of a filtering face mask in accordance with principles of the present invention.

In the depicted embodiment, all layers of a filtering face mask 100 are joined together, by heat sealing or welding, ultrasonic welding, stitching or other suitable means, at or close to the perimeter of each layer to form a unified assembly of layers 109. In the depicted embodiment, each of the layers of a filtering face mask 100 possess substantially the same shape, length and width. This facilitates, among other things, the joining together of the layers, along the perimeter of the common shape of the layers, to form a unified assembly. However, as shown in the depicted embodiment (FIGS. 3 and 4), the shape of the structure layer 120 deviates from this common shape in that there are two substantially triangular cutout areas 121 disposed substantially symmetrically on the structure layer 120, where no structure layer material exists. FIG. 3 depicts the mesh characteristic of a structure layer 120, while FIG. 4 depicts the outline of a structure layer 120 without showing the mesh feature to clearly illustrate the shape of the structure layer 120. These cutout areas 121 facilitate the ability of a filtering face mask 100 to fold when a person changes a filtering face mask 100 from an original two-dimensional configuration to a three-dimensional configuration (described in more detail below), and support the maintenance of the three-dimensional configuration.

Each cutout area 121 of structure layer 120 has two vertexes, 104*a* and 104*b*, that correspond in position or are adjacent to the perimeter 111 of layers 109. In other words, each vertex 104*a* and 104*b* corresponds to a point on perimeter 111 where a cutout area 121 breaks the continuity of the perimeter 111.

One skilled in the art will recognize that alternate embodiments of a face filtering mask may comprise more than two cutout areas, and that cutout areas may be other than triangular in shape.

The straps 150, which may be comprised of an elastic material or other material sufficiently stretchable to provide enough tension to hold the filtering face mask 100 to a person's face when placed on the person's head, typically over the ears. An example of such a material is Elastic Fabric 88225K61 sold by McMaster-Carr (www.mcmaster.com/#88225k61). Each strap 150 is attached by each strap end 151*a* and 151*b* to the filtering face mask 100 at strap attachment points 101 and 102, respectively. Attachment of the ends 151*a* and 151*b* of each strap 150 to the strap attachment points 101 and 102 can be accomplished by heat sealing or welding, ultrasonic welding, stitching, adhesive or other suitable means. In the depicted embodiment, the strap attachment points 101 and 102 are on the back layer 140 and each strap 150 runs through strap holes 105*a*-105*f*, which are disposed in various locations along, or close to, the perimeter 111 of the layers 109. However, in alternate embodiments (not shown), some or all of the strap attachment points are on the top layer 110, and thus some of the strap holes are eliminated.

As depicted in FIG. 2, each attachment point 101 and 102 is disposed outside of a cutout area 121, and adjacent or close to the perimeter 111 of the layers 109. Each attachment point 101 and 102 is more proximal to vertex 104*a* of a cutout area 121 than vertex 104*b* of a cutout area 121.

Each strap hole 105*a*-105*f* runs through the multiple layers of a filtering face mask 100, and thus, is actually comprised of a set of holes through each of the layers. For simplicity, each set of such associated holes is referred to merely as a single hole.

More specifically, as depicted in FIG. 2, strap ends 151*a* and 151*b* of a strap 150 are attached to back layer 140 at attachment points 101 and 102, respectively. A strap 150 is routed in order through the following sequence of strap holes:

1. Strap hole 105*a*
2. Strap hole 105*d*
3. Strap hole 105*e*
4. Strap hole 105*f*
5. Strap hole 105*c*
6. Strap hole 105*b*

Strap hole 105*a* is disposed outside of a cutout area 121 and more proximal to vertex 104*a* of the cutout area 121 than vertex 104*b* of the cutout area 121. Strap hole 105*b* is also disposed outside of a cutout area 121, more proximal to vertex 104*a* than vertex 104*b*, but also more proximal to vertex 104*a* than is strap hole 105*a*.

Strap hole 105*c* is within a cutout area 121 and more proximal to vertex 104*a* than vertex 104*b*. Strap hole 105*d* is also within a cutout area 121 but more proximal to vertex 104*b* than vertex 104*a*.

Strap hole 105*e* is disposed outside of a cutout area 121 and more proximal to vertex 104*b* than vertex 104*a*. Lastly, strap hole 105*f* is also disposed outside of a cutout area 121, more proximal to vertex 104*b* than vertex 104*a*, but also less proximal to vertex 104*b* than is strap hole 105*e*.

Note that strap holes 105*b* and 105*c* are disposed on opposite sides of one edge of a cutout area 121, and that strap holes 105*d* and 105*e* are disposed on opposite sides of the other edge of the cutout area 121

One skilled in the art will recognize that alternate embodiments of a filtering face mask may comprise more than two straps and more or less than six strap holes for each strap, and that the strap holes may be disposed in arrangements different than those that are disclosed herein. Furthermore, one skilled in the art will recognize that alternate embodiments of a filtering face mask may have routing orders of the straps through the strap holes different than that which is disclosed herein.

A filtering face mask 100 may comprise a nosepiece 160, made of metal or other suitable flexible, semi-rigid material that can be bent by a person after placing a filtering face mask on their face in order to improve the fit of the filtering face mask 100. Some embodiments of a filtering face mask 100 comprise a nosepiece made of soft, moldable foam instead of metal. A nosepiece 160 may comprise an aluminum wire or strip encapsulated in a plastic (e.g., polypropylene or similar material) sheet, and may be secured by stitching, heat welding, or ultrasonic welding or other suitable method to either side of structure layer 120. The shape of a nosepiece 160 may be straight or slightly curved. The dimensions of a nosepiece 160 may range from 1.5" to 3" in length, 1/16" to 1/4" in width, and 1/32" to 1/8" in thickness. A nosepiece 160 may be positioned approximately 1/8" to 1/2" from the upper (when worn on a person's face) end of a filtering face mask 100.

A filtering face mask 100 is of sufficient dimensions to cover a person's nose and mouth when worn. In its wearable, three-dimensional configuration, a filtering face mask 100 may vary in diameter from 3.5" for a mask suitable in size for a child to 5" for a mask suitable in size for an adult. Other dimensions may be used for suitability to a particular age group, e.g., infants, small children, adults. Each strap 150 is of sufficient length to run through the strap holes as described above, and to be worn by a user as described above, such that each strap 150 provides sufficient tension to hold the filtering face mask 100 on a user when worn. Typical lengths of a strap 150 vary from 5 inches to 10 inches.

A filtering face mask 100, as described above, is originally in a two-dimensional configuration, i.e., it is originally substantially flat. A person may change the configuration of a filtering face mask 100 from the original two-dimensional configuration to a three-dimensional configuration; this allows the filtering face mask 100 to assume a face-fitting shape suitable to be worn on a person's face. Having an originally flat configuration provides advantages of storage and portability over other existing face masks that have an original three-dimensional form.

Figure 6:
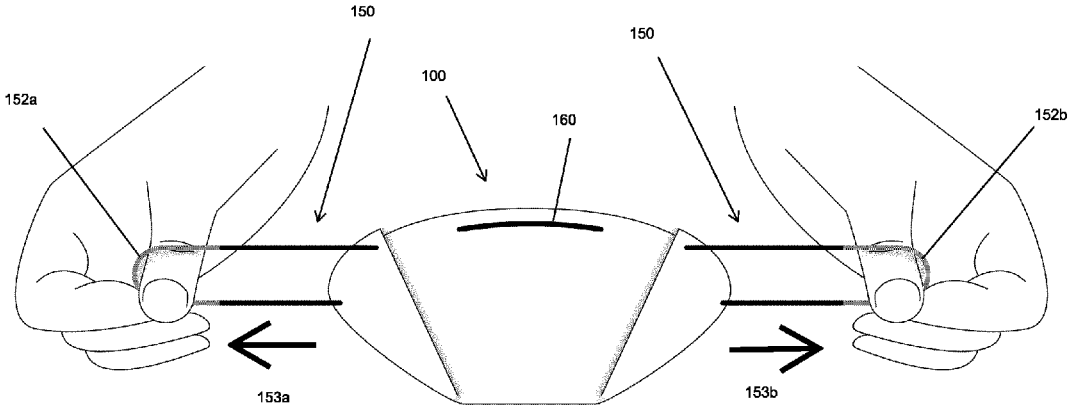
FIGS. 6-14 depict the action of changing a filtering face mask from a two-dimensional configuration to a three-dimensional configuration.
Figure 7:
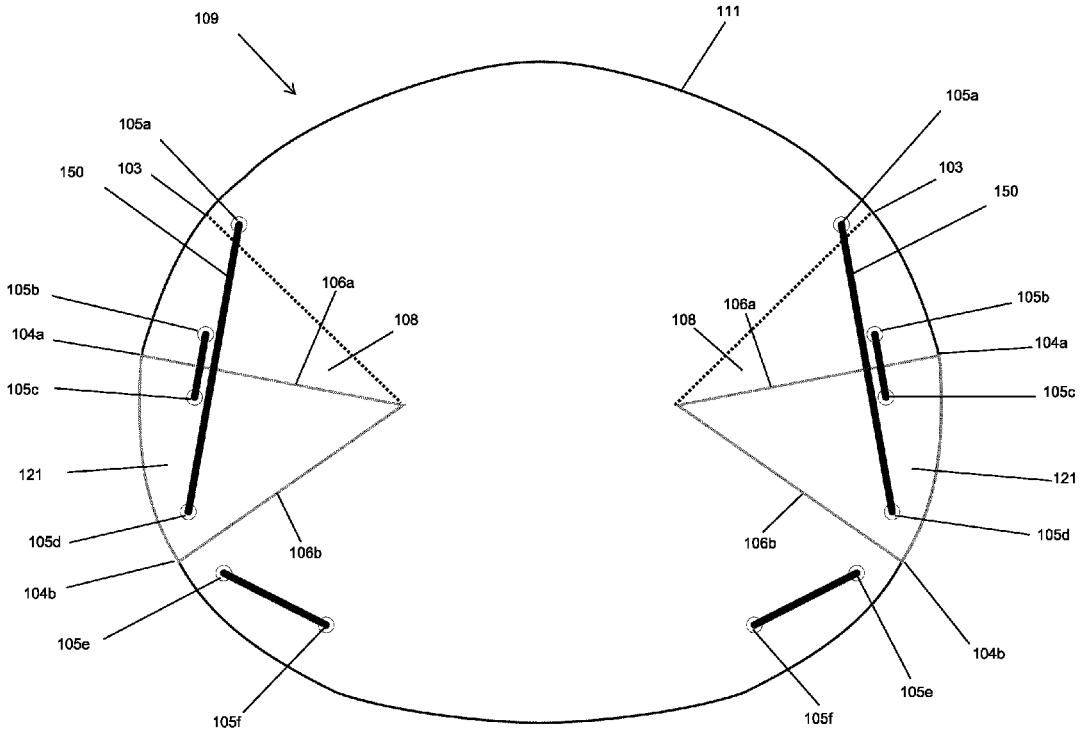
Figure 8:
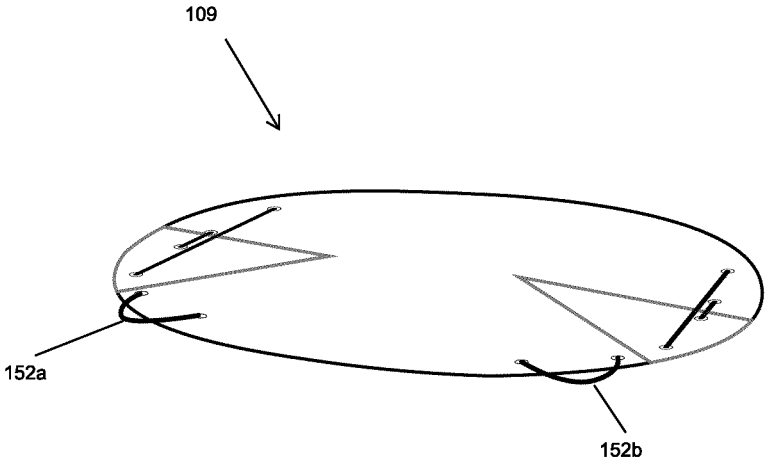
Figure 9:
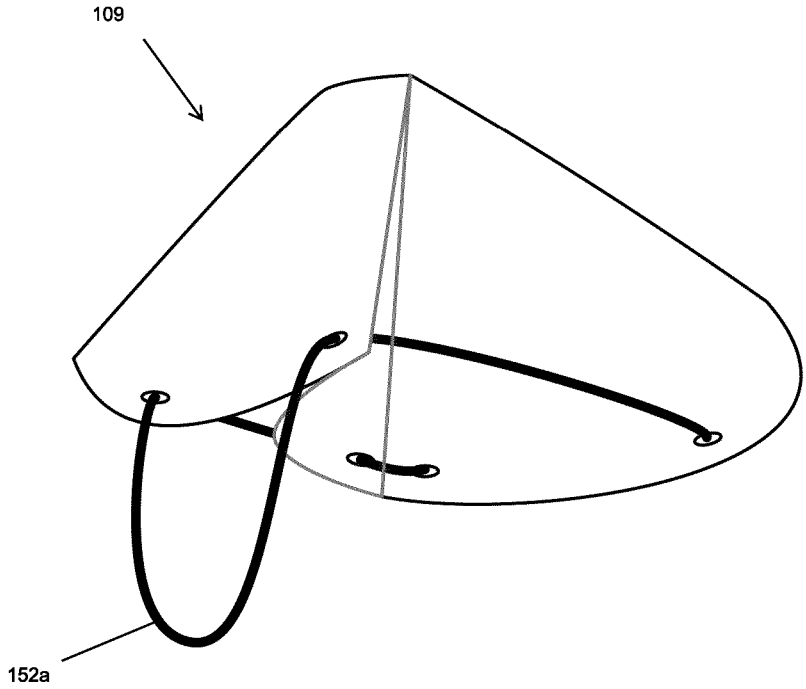

This configuration change, which requires no additional components or tools, is depicted in FIGS. 8-14; FIG. 7 depicts some of the elements of a filtering face mask 100 that are involved in the configuration change. The configuration change from a substantially, flat two-dimensional configuration to a wearable, three-dimensional configuration is performed by the single action of pulling on each strap 150 at each pull segment 152*a* and 152*b* in substantially opposing directions 153*a* and 153*b*, as depicted in FIG. 6. (Pull segments 152*a* and 152*b* may be of a different color or shade than the rest of strap 150, thus making it easy for a person to identify the appropriate place on each strap by which to grasp and pull the strap.) This action causes each strap 150 to be pulled through strap hole 105*e*, thus creating and/or increasing tension of each strap 150 against the strap attachment points 101 and 102, causing the filtering face mask 100 to fold along fold lines 106*a* and 106*b* in such a way so that an area of the filtering face mask 100 that is substantially congruent with cutout area 121 is pulled to overlap similarly congruent fold area 108, and vertex 104*b*, which is substantially adjacent to an edge of cutout area 121 at the perimeter of filtering face mask 100, is pulled to substantially coincide with fold point 103.

For a filtering face mask 100 that comprises a nosepiece 160, after a person changes the mask from two-dimensional to three-dimensional configuration, the person performs the additional step of bending and/or molding the nosepiece 160 to conform in shape to the bridge of the person's nose.

The cutout areas 121 of the structure layer 120 facilitate the above described configuration change, as the cutout areas are substantially congruent with the fold areas 107 and 108, and thus the absence of structure layer material in the fold areas 107 and 108 allow for a folding action to take place with only a small pull force.

In addition to the advantage provided by the arrangement of straps described herein of requiring only a single action to change a filtering face mask 100 from a two-dimensional to a three-dimensional configuration, there is also the advantage of not providing an easy method for changing a filtering face mask 100 back from a three-dimensional to a two-dimensional configuration. Such a configuration change would require careful pulling of straps 150 through strap holes 105, and unfolding fold areas 107 and 108. This is an advantage when the wearer of a filtering face mask 100 is a child (e.g., a pediatric medical patient), since it is a medical goal to ensure that the child does not stop wearing the mask when it should be worn.

Furthermore, another advantage of the cutout areas 121 is that the absence of structure layer material in the fold areas 107 and 108 helps the filtering face mask 100 to maintain the three-dimensional configuration, since fold lines 106*a* and 106*b* do not involve structure layer material which if folded would resist the fold and provide force against the folds.

Yet another advantage of the cutout areas 121 is that filtering face masks 100 fold in a repeatable way to yield a wearable three-dimensional configuration of substantially uniform dimensions. This ensures that a face filtering mask 100 of given dimensions in its flat, two-dimensional configuration will be changed to a wearable configuration of predicted desired dimensions.

Figure 1:
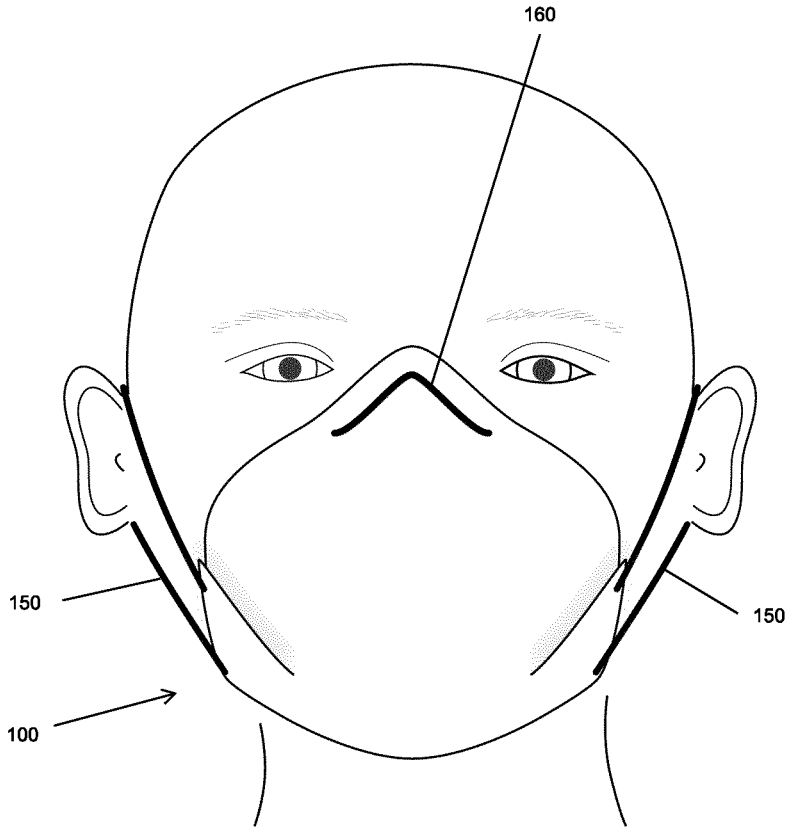
FIG. 1 depicts a person using a filtering face mask in accordance with principles of the present invention.
Figure 10:
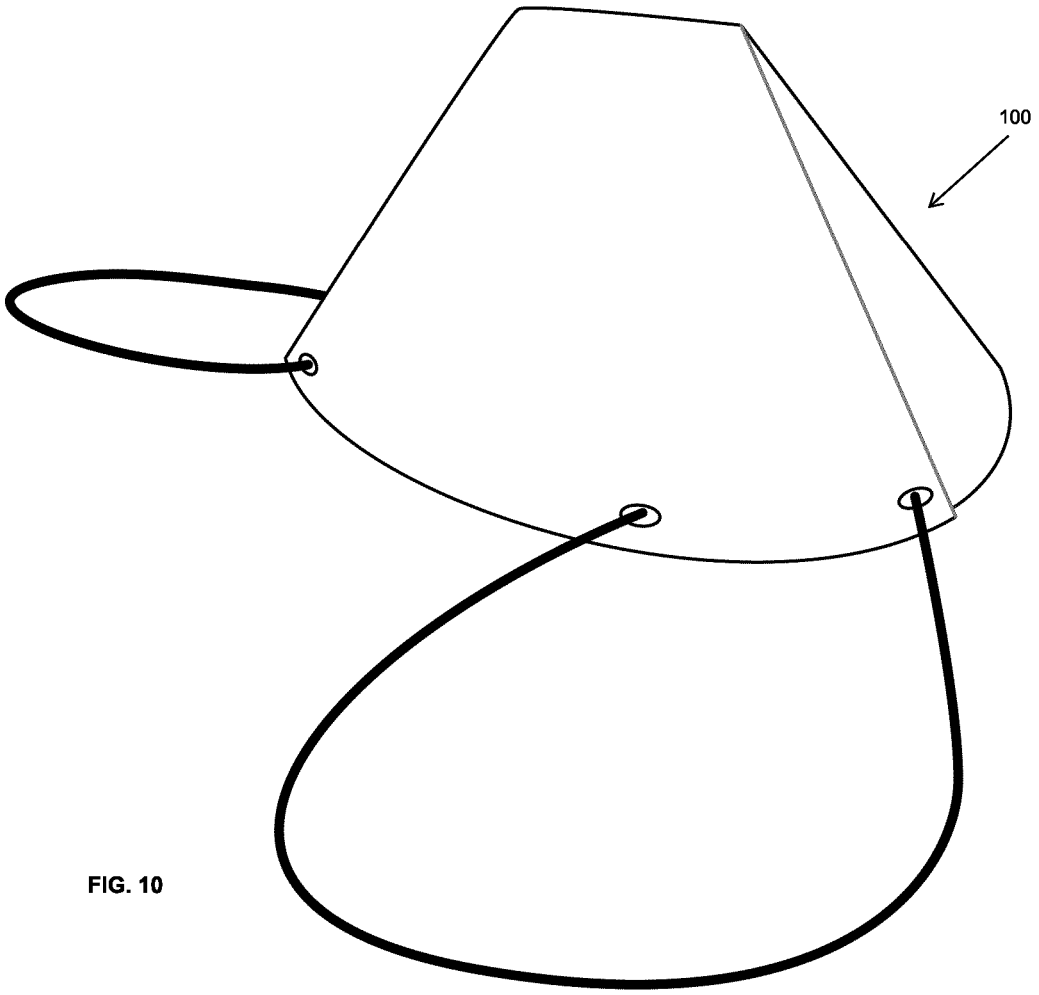
Figure 11:
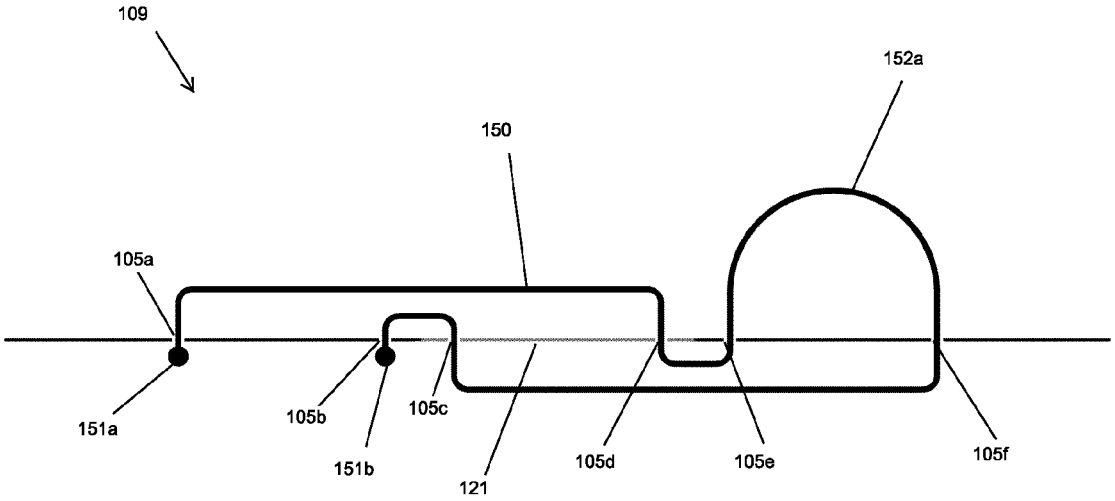
Figure 12:
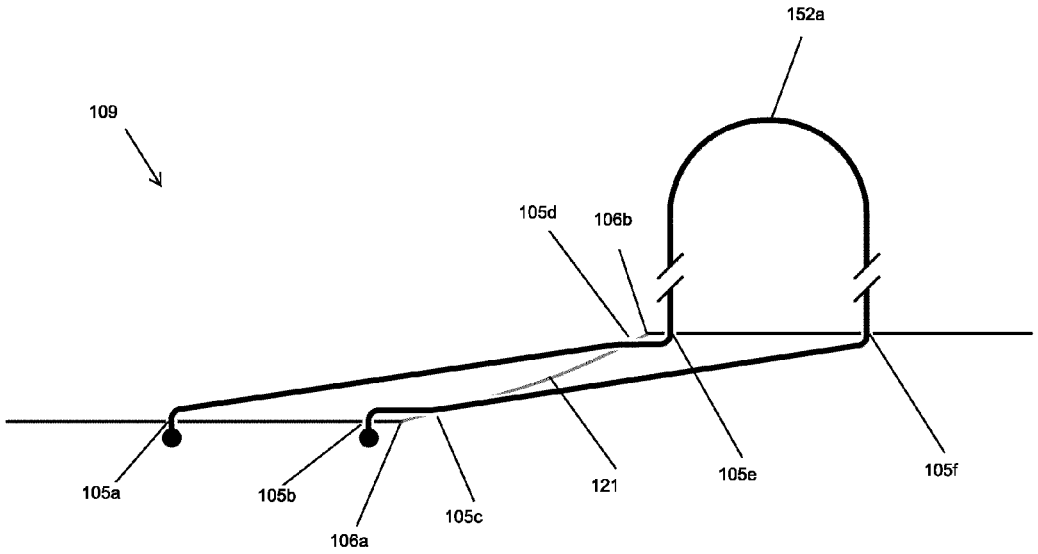
Figure 13:
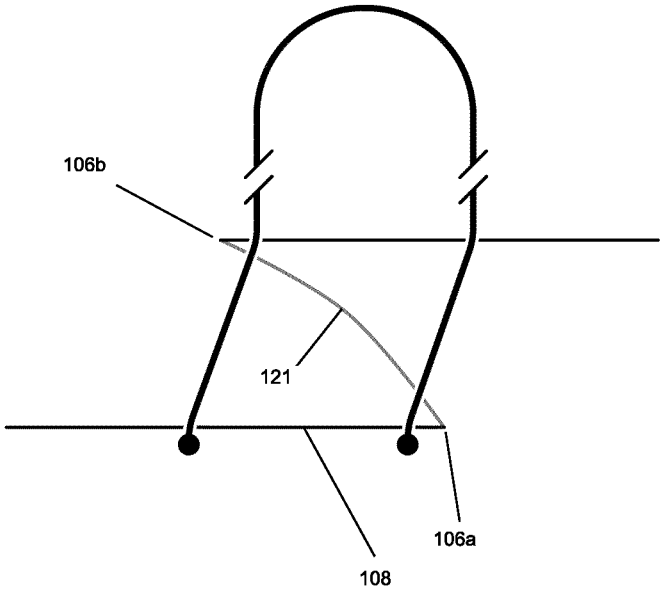
Figure 14:
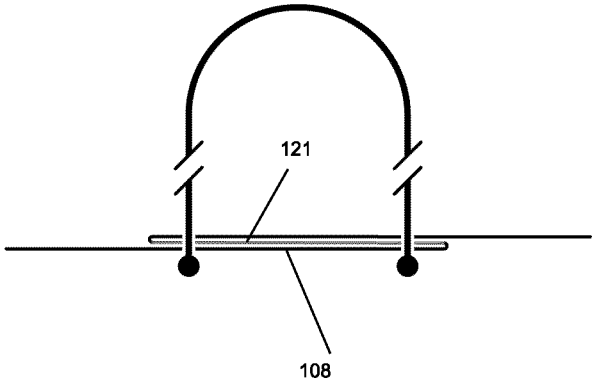

Another benefit of structure layer 120 is that it allows a filtering face mask 100 to assume and maintain a substantially "cupped" shape (as depicted in FIGS. 1, 6 and 10) when the filtering face mask 100 is in a three-dimensional configuration. The rigidity provided by structure layer 120 provides resistance against the force of an inhalation by the person wearing the mask, and thus the filtering face mask 100 does not collapse and touch the wearer's face when they inhale. Because of this, a person wearing a filtering face mask 100 is provided with greater physical comfort.

Figure 15:
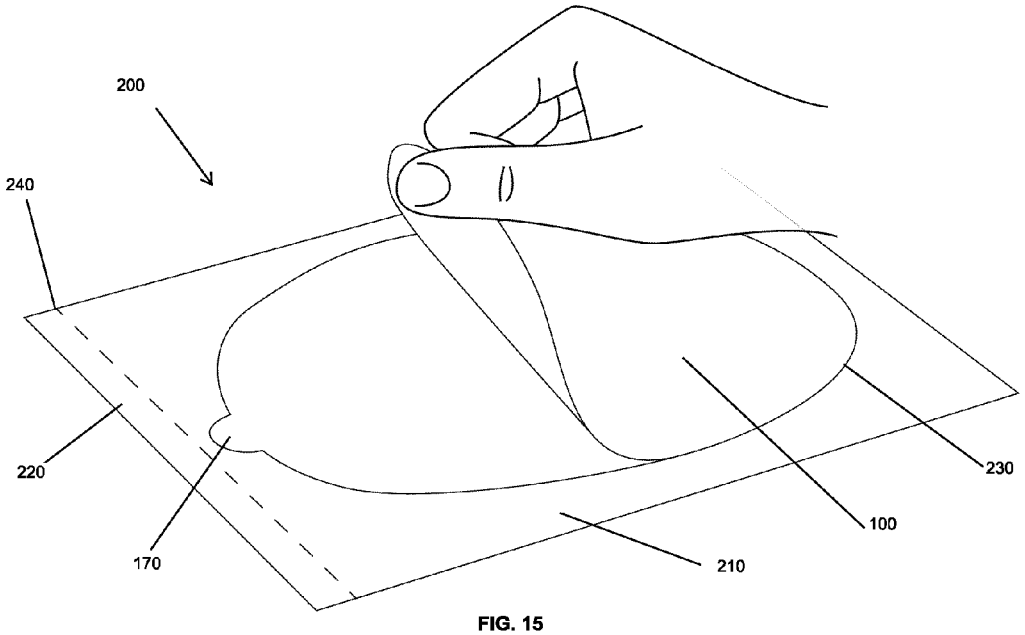
FIG. 15 depicts a perspective view of a person removing a filtering face mask from a sheet in accordance with principles of the present invention.

As depicted in FIG. 15, filtering face mask 100 may be incorporated into a flat sheet 200. In more detail, a flat sheet 200 may comprise a filtering face mask 100, excess sheet material 210. and binding 220. (Some components and features of a filtering face mask 100, e.g., straps, strap holes, strap attachment points, are not shown in FIG. 15, for simplicity.) In the depicted embodiment, the filtering face mask 100 is surrounded by the excess sheet material 210, and the excess sheet material 210 is attached to the binding 220. The excess sheet material 210 further comprises a tear-away opening 170, an absence of material providing a person an opening by which to grasp and pull the filtering face mask 100 away from the flat sheet 200. Alternate embodiments of a flat sheet 200 include a tear-away tab (not shown), which is a small piece of material that extends beyond the perimeter 111 of layers 109 for providing a person with an alternate means to grasp and pull the filtering face mask 100 away from the flat sheet 200.

The flat sheet 200 is comprised of the above described layers (top, structure, filter and back), and the interface 230 of each corresponding layer between the filtering face mask 100 and the excess sheet material 210 is perforated, such that a user can pull on the filtering face mask 100 to remove the filtering face mask 100 from the flat sheet 200 by separating the filtering face mask 100 from the excess sheet material 210. The interface 240 of the excess sheet material 210 and the binding 220 is similarly perforated, making it easy to remove the excess sheet material 210 after the filtering face mask 100 is separated from the excess sheet material 210.

A flat sheet 200 is typically of a height between 6 to 8 inches and a length between 7 to 9 inches.

Figure 16:
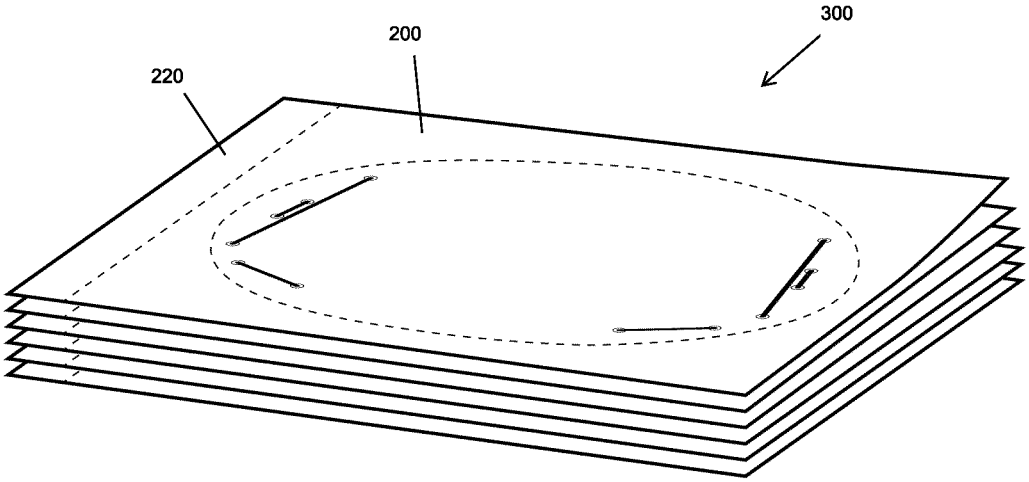
FIG. 16 depicts an exploded view of a booklet of filtering face masks in accordance with principles of the present invention.

One or more flat sheets 200 may be packaged in a booklet assembly 300, as depicted in exploded view in FIG. 16 where the binding 220 of each flat sheet 200 is joined by heat sealing or welding, ultrasonic welding, stitching or other suitable means.

The dimensions of a booklet assembly 300 may vary to accommodate different mask sizes. For example, three different mask sizes can be provided to fit children of varying ages. A booklet assembly 300 can be replaced by a user (or his or her parent) with a booklet assembly 300 comprised of masks of a different (typically larger) size when all of the masks are used or if the fit is not appropriate.

The top layer 110 of a filtering face mask 100, which is unpleated, provides, in its original substantially flat, two-dimensional configuration, a convenient surface for a person to graphically decorate, with for example, drawings or text. The two-dimensional, substantially unbroken, unpleated surface provided by the top layer 110 also affords an advantage over other existing face masks that are either originally in a three-dimensional configuration, or originally two-dimensional with one or more pleats in their surface. The former is difficult for a person to draw or write upon because it is not flat. The latter preserves neither drawing nor text when the pleats unfold when changed to three-dimensional form. The top layer 110 of a filtering face mask 100 operates differently, as its surface remains substantially unbroken and continuous when the mask is changed from its original two-dimensional configuration to a three-dimensional configuration, except for the fold areas 107 and 108, which are not visible in the wearable, three-dimensional configuration of a filtering face mask 100.

The incorporation of a structure layer 120 in a filtering face mask 100 in between the top layer 110 and the filter layer 130, as depicted and described herein, protects the filter layer 130 from decorative substance (e.g., ink) that penetrates the top layer 110. This provides an advantage when a filtering face mask 100 is decorated, since otherwise such decorative substance might adversely affect the filtering performance of the filtering layer 130.

Another benefit of structure layer 120 is that it provides a stiff undersurface for decoration, preventing the filtering face mask 100 from being crushed or flexed when a person is decorating the top layer 110.

In some embodiments, the top layer 110 of a filtering face mask 100 has preprinted decorative images (not shown), similar to those in a child's coloring book, that can used as a starting point for decoration.

Figure 17:
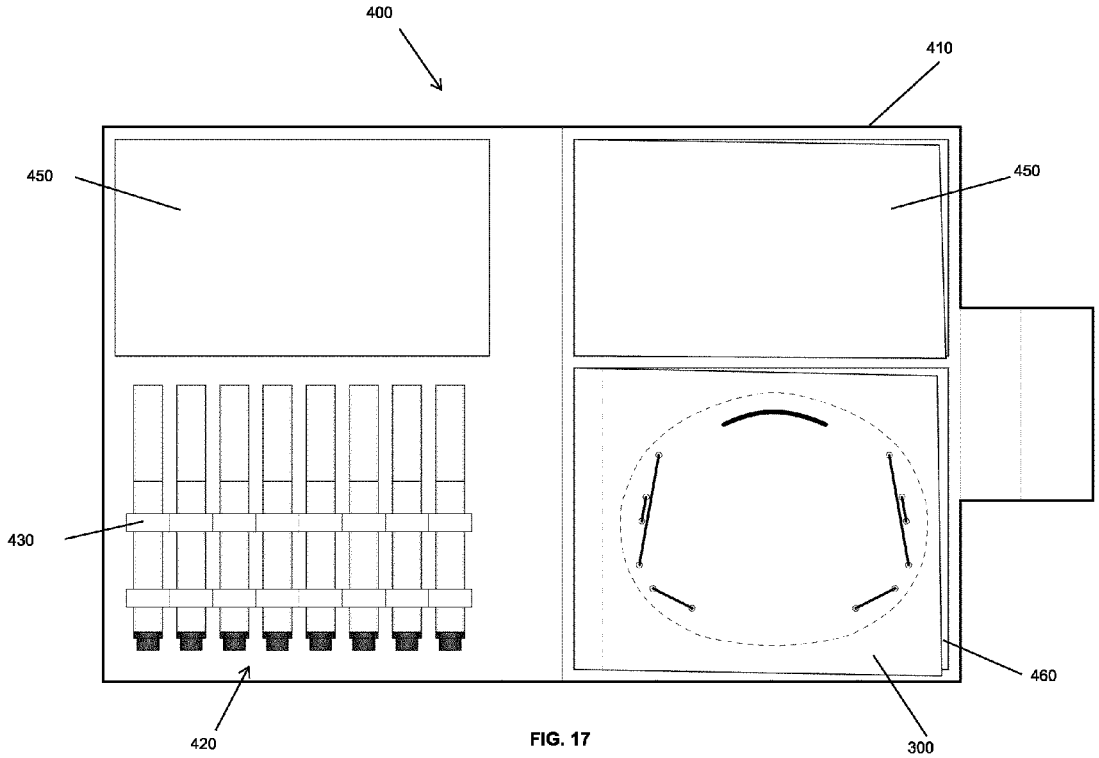
FIG. 17 depicts a top plan view of a filtering face mask packaging arrangement in accordance with principles of the present invention.

A booklet assembly 300 of flat sheets 200 may be incorporated into a kit assembly 400, as depicted in FIG. 17. A kit assembly 400 may comprise, in addition to a booklet assembly 300, a closable cover 410, tools 420 for decorating a filtering face mask, a mechanism 430 to store the tools for decorating a filtering face mask, instructions 440 for decorating, deploying, and wearing a filtering face mask, inspiration 450 for decorating a filtering face mask (i.e., suggestions or prompts in the form of text, graphic or both, to inspire a user in decorating), and a mechanism 460 for holding a replaceable booklet of filtering face masks.

In the depicted embodiment, closable cover 410 contains within it the components of a kit assembly 400, and can be folded to protect and hold these components and to provide a portable means for a kit assembly 400. The following components, tool storage mechanism 430, instructions 440, inspiration 450 and booklet holding mechanism. are attached to the inside of closable cover 410. Some embodiments of a kit assembly 400 include a closable cover 410 with dimensions of 8.5 inches by 11.5 inches, however, embodiments having other dimensions are possible.

In some embodiments of a kit assembly 400, a closable cover 410 is comprised of a stiff material such as cardboard, instructions 440 are comprised of paper, and inspiration 450 is comprised of one or more sheets of paper bound into a booklet (distinct from filtering face mask booklet assembly 300). Both instructions 440 and inspiration 450 are adhered to cover 410 with an adhesive. Tools 420 comprise one more colored markers; tool storage mechanism 430 comprises one more loops of elastic that are adhered, or otherwise attached, to the inside of closable cover 410. Booklet holding mechanism 460 is comprised of material similar to the material of which closable cover 410 is comprised.

Although exemplary embodiments of the present invention have been described above, it is not limited thereto. The appended claims should be construed broadly to include other variants and embodiments of the invention which may be made by those skilled in the art without departing from the scope and range of equivalents of the invention. This disclosure is intended to cover any adaptations or variations of the embodiments discussed herein.

What is claimed is:

1. A filtering face mask, the mask comprising:

two straps, each having a first and second end point, one or more structure layers, said structure layers comprising material sufficient to maintain a substantially three-dimensional configuration, each structure layer comprising two or more cutout areas where no structure layer material exists, said cutout areas facilitating an ability of the mask to fold during a configuration change from a substantially two-dimensional flat configuration to the substantially three-dimensional configuration due to an absence of structure layer material in the cutout areas;

one or more filter layers, said one or more filter layers comprising material sufficient to reduce a presence of certain substances in air that passes through the one or more filter layers, said one or more filter layers not having cutout areas, said one or more structure layers and said one or more filter layers having substantially the same length and width, and at least one of said layers comprising two or more strap holes;

wherein the end points of each of the straps are attached to said layers at a pair of attachment points, each pair of attachment points comprising a first and a second attachment point, and the straps run through the strap holes;

wherein the mask is configured to undergo the configuration change from said substantially two-dimensional flat configuration to said substantially three-dimensional configuration when the straps are pulled.

2. The filtering face mask of claim 1, wherein said layers are configured to fold when the straps are pulled causing the mask to undergo said configuration change.

3. The filtering face mask of claim 1, wherein said cutout areas are substantially triangular.

4. The filtering face mask of claim 1, said layers having a perimeter, each of said cutout areas having a first vertex adjacent to said perimeter of the layers and a second vertex adjacent to said perimeter of the layers, wherein each pair of attachment points is disposed outside of a respective one of said cutout areas and adjacent to said perimeter of the layers and more proximal to the first vertex of said respective one of said cutout areas than the second vertex of said respective one of said cutout areas, and two of said strap holes are disposed adjacent to, and on opposing sides of, the second vertex of said respective one of said cutout areas.

5. The filtering face mask of claim 1, wherein at least some of said structure layers comprise a mesh material.

6. The filtering face mask of claim 1, comprising two or more filter layers, wherein at least one of said structure layers is disposed between two of the filter layers.

7. The filtering face mask of claim 1, wherein said layers are configured to fold when the straps are pulled in substantially opposing directions.

8. The filtering face mask of claim 1, wherein at least some of said one or more structure layers and said one or more filter layers comprise a non-woven polypropylene material.

9. The filtering face mask of claim 1, further comprising a nosepiece made of flexible, semi-rigid material.

10. The filtering face mask of claim 1, the mask further comprising:

a top layer;

wherein said top layer is comprised of material suitable for graphic decoration.

11. The filtering face mask of claim 10, wherein said top layer is substantially unpleated.

12. The filtering face mask of claim 10, said one or more structure layers comprising material sufficient to provide a stiff undersurface for decoration.

13. The filtering face mask of claim 10, wherein said top layer has preprinted decorative images.

14. The filtering face mask of claim 10, wherein said top layer is substantially unbroken and continuous.

* * * * *